US007458326B2

(12) United States Patent
Yamaguchi et al.

(10) Patent No.: US 7,458,326 B2
(45) Date of Patent: Dec. 2, 2008

(54) OVERLOCK SEWING MACHINE

(75) Inventors: Matsuo Yamaguchi, Mizunami (JP); Hiroki Hayashi, Toki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 330 days.

(21) Appl. No.: 11/359,525

(22) Filed: Feb. 23, 2006

(65) Prior Publication Data

US 2006/0191453 A1 Aug. 31, 2006

(30) Foreign Application Priority Data

Feb. 25, 2005 (JP) ..... 2005-050209

(51) Int. Cl.
*D05B 57/00* (2006.01)
*D05B 69/00* (2006.01)

(52) U.S. Cl. ..... 112/200; 112/220

(58) Field of Classification Search ..... 112/162, 112/165, 166, 172, 176, 177, 199, 200, 284
See application file for complete search history.

(56) References Cited

U.S. PATENT DOCUMENTS 3,301,207 A * 1/1967 Reeber et al. ..... 112/200
4,690,080 A * 9/1987 Mikuni et al. ..... 112/162
4,967,677 A 11/1990 Seiriki et al.
4,977,842 A 12/1990 Fukao et al.
5,237,942 A * 8/1993 Satoma ..... 112/162
5,704,303 A * 1/1998 Tseng ..... 112/200
5,732,639 A * 3/1998 Kojima et al. ..... 112/162
6,880,472 B2 * 4/2005 Horiuchi ..... 112/199
7,011,032 B1 * 3/2006 Chang ..... 112/200

FOREIGN PATENT DOCUMENTS

JP B2 58-19317 4/1983
JP A-1-303194 12/1989
JP Y2 6-04875 2/1994
JP Y2 7-19435 5/1995
JP B2 2624512 4/1997

* cited by examiner

*Primary Examiner*—Ismael Izaguirre
(74) *Attorney, Agent, or Firm*—Oliff & Berridge, PLC

(57) ABSTRACT

An overlock sewing machine including a main shaft rotated by a sewing machine motor; a vertically moving sewing needle and an overlooper and an underlooper respectively driven by the rotation of the main shaft; a single looper drive shaft forming overlock stitches in cooperation with the overlooper, the underlooper and the sewing needle and rotated by the rotation of the main shaft, shaft line thereof being arranged perpendicularly to the main shaft; and a swing generating member having first and second swing generating portions fixed to the looper drive shaft for swinging the overlooper and the underlooper respectively; a first and second swing link mechanisms, both of which extend perpendicularly to the looper drive shaft, swinging the overlooper and the underlooper by conveying the drive force generated by the first and second sewing generating portions.

15 Claims, 12 Drawing Sheets

OVERLOCK SEWING MACHINE

CROSS-REFERENCE TO RELATED APPLICATIONS

This application is based upon and claims the benefit of priority from the prior Japanese Patent Application No. 2005-050209, filed on, Feb. 25, 2005 the entire contents of which are incorporated herein by reference.

TECHNICAL FIELD

The disclosure relates to an overlock sewing machine that forms an overlock stitch by cooperation of a sewing needle, an overlooper and an underlooper.

BACKGROUND

A conventional overlock sewing machine, or the so called lock sewing machine, is provided with a main shaft rotated by a sewing machine motor, a sewing needle vertically moved by the rotation of the main shaft, and an overlooper and an underlooper swung by the rotation of the main shaft. Overlock stitches are formed on a cloth by swinging the overlooper and the underlooper in synchronization with the vertical movement of the sewing needle.

Aforementioned types of sewing machines are disclosed for example in JP-B-S58-19317 and JP-Y-H6-4875. In such overlock sewing machines, drive shafts for driving the overlooper and the underlooper respectively are arranged in a direction perpendicular to the main shaft which is disposed horizontally near the border of a bed and an arm. The drive shafts are respectively rotated in a reciprocating manner by 2 eccentric cams provided on the main shaft. The overlooper and the underlooper are swung via link mechanisms linked to the respective drive shafts.

Since conventional overlock sewing machines have a dedicated eccentric cam and drive shaft for the overlooper and the underlooper respectively, increased number of parts are required for the drive mechanism of the foregoing, thereby increasing the cost and the overall size. Furthermore, such construction requires laborious and troublesome installation and timing adjustment.

In such type of overlock sewing machines, thread engagement work for setting a looper thread to the underlooper need to be performed before starting the sewing operation which is relatively troublesome for the user. JP-Y-H7-19435 and JP-A-2624512 disclose an overlock sewing machine having a construction that renders a simplified looper thread engagement of the underlooper. Under such construction, the underlooper is mounted on a looper arm fixed to a looper shaft via a threading base. Also, a guide rail supporting a slider thereon is fixed to the threading base, allowing the slideable operation of the slider.

Upon engaging the thread to the underlooper, first, the user is required to pull open a bed cover of the bed. Then the looper arm is moved to the right most position so that the distal end of the underlooper is exposed to the exterior of the bed. Next, the user pulls out the slider and passes the looper thread through the threading eyelet on the distal end of the underlooper and engages the thread to the thread transferring member of the slider. Thereafter, the slider is pushed in the returning direction. The foregoing manual operation enables the looper thread to be engaged to a thread engagement portion in the base end of the underlooper.

However, in such construction, the provision of the threading base for thread engagement, the guide rail, and the slider increases the number of parts as well as the cost, consuming considerable time upon installation. Moreover, upon engaging the thread to the underlooper, after pulling out the slider and engaging the looper thread to the thread transferring member, the slider needs to be pushed back in. Thus, thread engagement work cannot be sufficiently simplified.

SUMMARY

Therefore a first object of the present disclosure is to simplify the drive mechanism of the overlooper and the underlooper and to provide an overlock sewing machine capable of improving the installability of the drive mechanism. A second purpose of the present disclosure is to further provide an overlock sewing machine capable of sufficiently simplifying the thread engagement work of the underlooper.

The overlock sewing machine of the present disclosure is provided with a main shaft rotated by a sewing machine motor, a sewing needle vertically driven by the rotation of the main shaft and an overlooper and an underlooper driven by the rotation of the main shaft.

The overlock sewing machine is further provided with a single looper drive shaft forming overlock stitches in cooperation with the overlooper and the underlooper and the sewing needle, and having a shaft line arranged perpendicularly to the main shaft, the single looper drive shaft rotated by the rotation of the main shaft; and a swing generating member which is fixed to the looper drive shaft and having a first swing generating portion for swinging the overlooper, and a second swing generating portion for swinging the underlooper.

The overlock sewing machine is yet further provided with a first swing link mechanism extending in a direction perpendicular to the looper drive shaft and swinging the overlooper by conveying the drive force generated by the first sewing generating portion; and a second swing link mechanism extending in a direction perpendicular to the looper drive shaft and swinging the underlooper by conveying the drive force generated by the second sewing generating portion.

Since the swing generating member having the first and second swing generating portions for swinging the overlooper and the underlooper respectively is fixed to a single looper drive shaft, a separate drive shaft and a separate eccentric cam need not be provided to the overlooper and the underlooper. Therefore, the configuration of the drive mechanism for the overlooper and the underlooper can be simplified, requiring fewer parts. Moreover, timing adjustment only needs to be performed once and installability is greatly improved.

Also, the overlock sewing machine of the present disclosure is provided with a main shaft rotated by a sewing machine motor, a sewing needle vertically driven by the rotation of the main shaft and an overlooper and an underlooper driven by the rotation of the main shaft.

The overlock sewing machine is further provided with a single looper drive shaft forming overlock stitches in cooperation with the overlooper, underloopers and the sewing needle, and having a shaft line arranged perpendicularly to the main shaft, the single looper drive shaft rotated by the rotation of the main shaft; and a swing generating member which is fixed to the looper drive shaft and having a first swing generating portion for swinging the overlooper, and a second swing generating portion for swinging the underlooper.

The overlock sewing machine is yet further provided with a first swing link mechanism extending in a direction perpendicular to the looper drive shaft and swinging the overlooper by conveying the drive force generated by the first sewing generating portion; and a second swing link mechanism extending in a direction perpendicular to the looper drive shaft and swinging the underlooper by conveying the drive force generated by the second sewing generating portion.

The overlock sewing machine is yet further provided with a switch mechanism switching the underlooper from a sewing position to a threading position which is outside a swing range at the time of sewing. Also, in the thread position, threading of a threading eyelet on the distal end of the underlooper and thread engagement of the base end of a thread engagement portion can be performed from the exterior. A returning mechanism is provided for automatically returning the underlooper to the sewing position from the threading position upon sewing start.

By switching the underlooper to the threading position, the thread engagement can be easily carried out externally. At this time, the threading base, the guide rail, and the slider can be eliminated, allowing for a simplified mechanism. Moreover, since the underlooper is automatically returned from the threading position to the sewing position at the time of sewing start, sewing can be started without interruption even in case the user forgets the returning operation of the underlooper to the sewing position after carrying out the thread engagement.

BRIEF DESCRIPTION OF THE DRAWINGS

Other objects, features and advantages of the present invention will become clear upon reviewing the following description of the embodiment example with reference to the accompanying drawings, in which.

DETAILED DESCRIPTION OF THE PREFERRED EMBODIMENT

Figure 1:
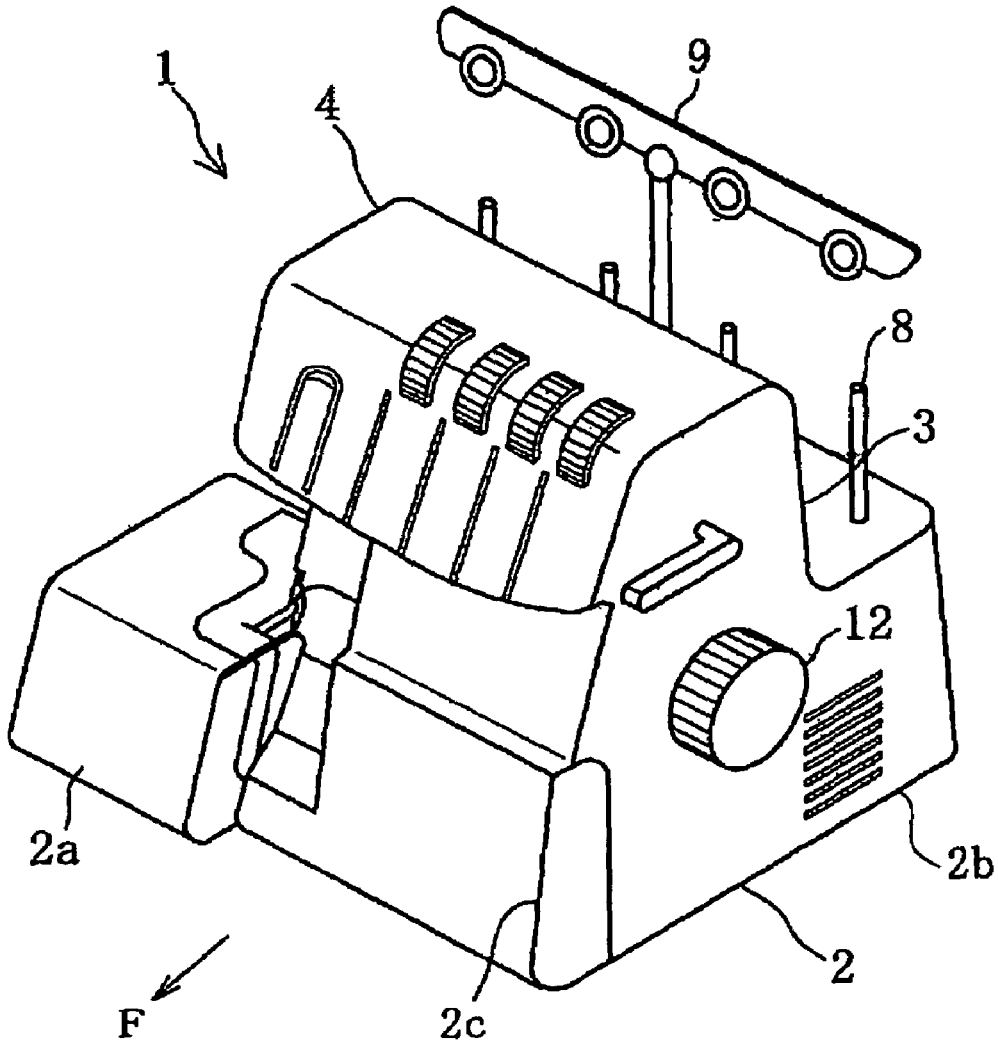
FIG. 1 is a perspective view of an illustrative aspect of the disclosure, showing an external appearance of an overlock sewing machine.

One embodiment of the present invention will be described hereinafter with reference to the drawings. Description which will be given hereinafter is to be construed with an understanding that the direction indicated by the arrow F in the drawings such as FIGS. 1 and 3 is the front side.

Figure 2:
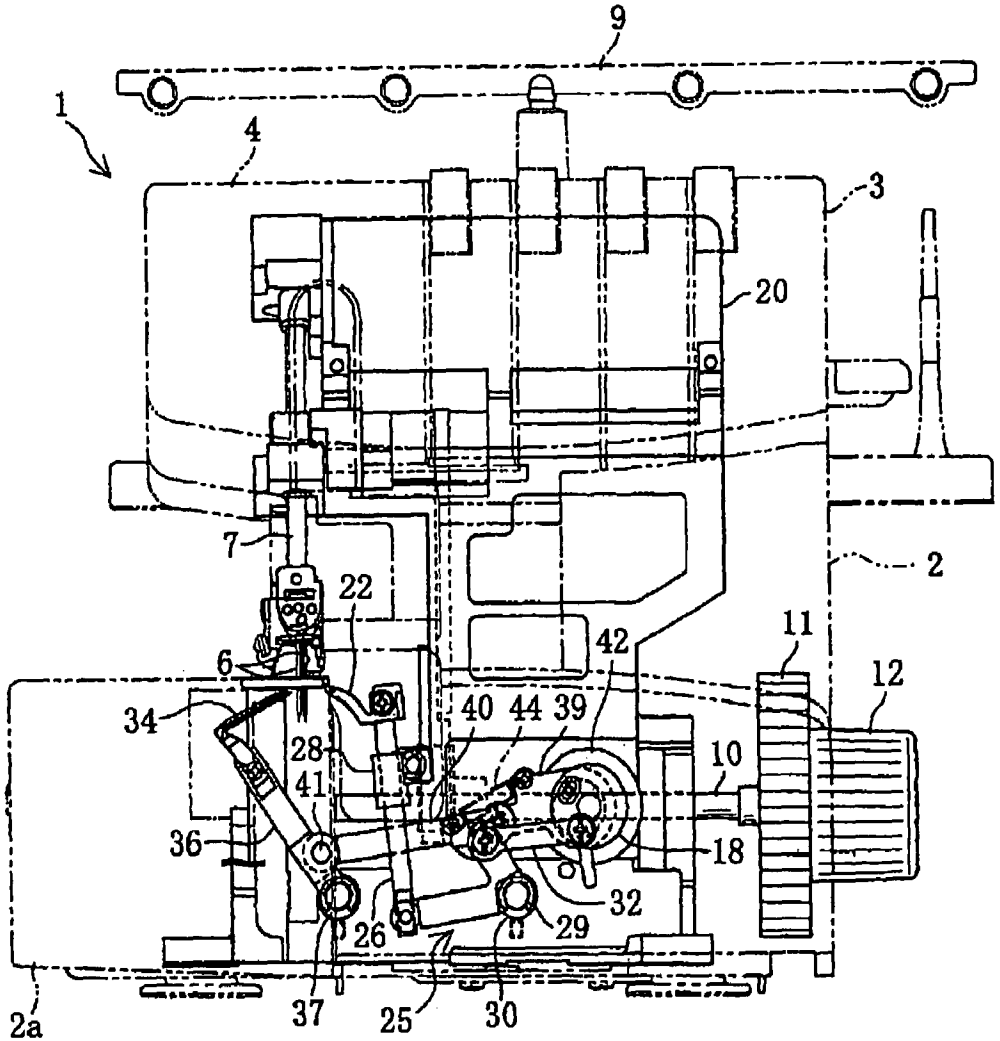
FIG. 2 is a front view of an internal structure.
Figure 3:
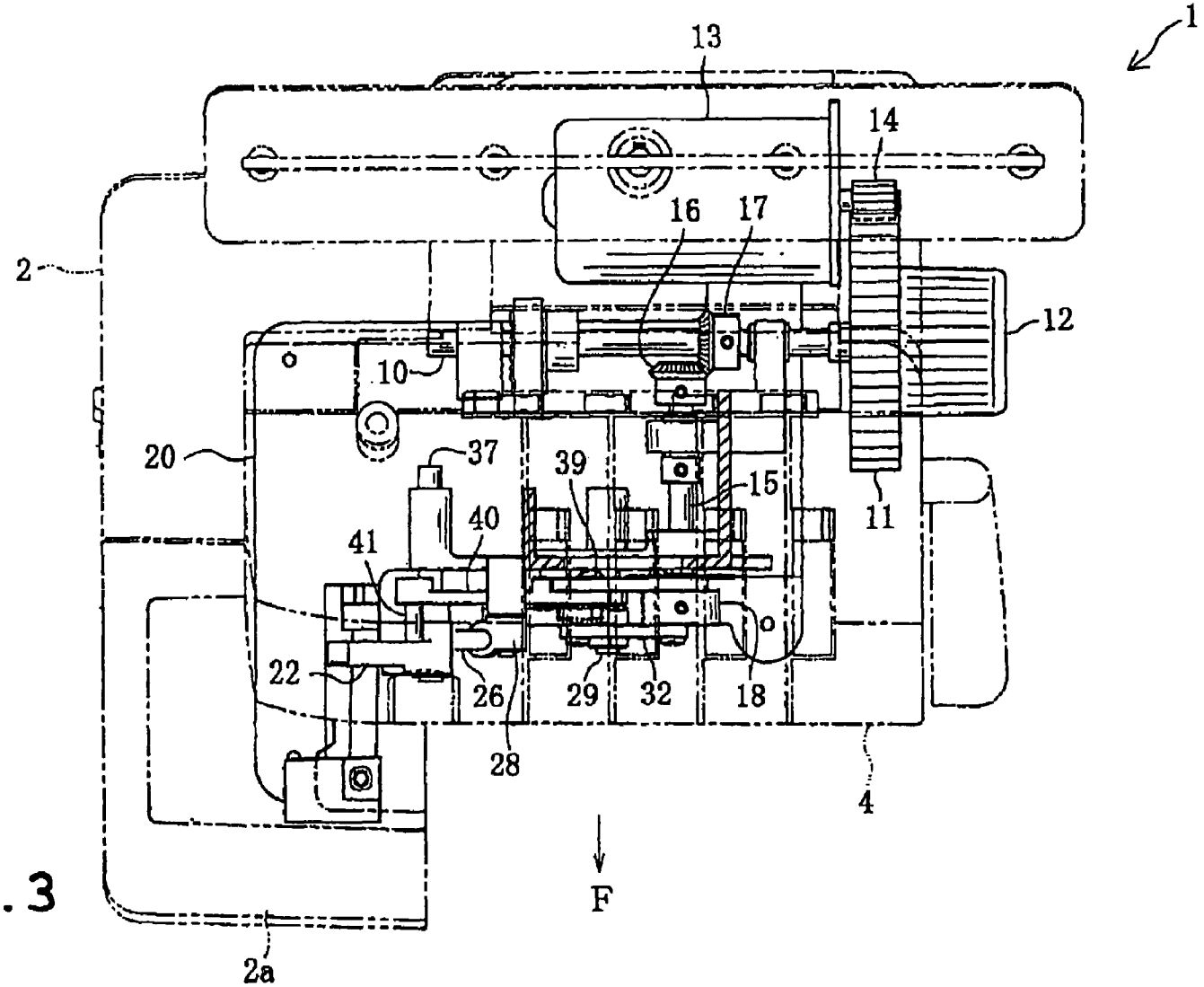
FIG. 3 is a plan view of the internal structure.

An overlock sewing machine 1, as shown in FIGS. 1 to 3 is integrally provided with a bed 2 having a free bed 2*a* with the left end thereof protruding in the forward direction, a pillar 3 extending upward from the bed 2, and an arm 4 extending in the horizontal direction from the upper portion of the pillar 3.

As shown in FIG. 2, the arm 4 has a needle bar 7 inclined toward the front and having, for example, two sewing needles 6 in the lower end thereof. The needle bar 7 is vertically moved by a rotation of the main shaft 10 via a drive mechanism not shown. Also, though neither of which are shown, the arm 4 has a presser foot and a vertical drive mechanism therefor, a thread take-up and a drive mechanism therefor, and the like.

On the other hand, as shown in FIG. 1, a plurality of thread pins 8 and thread guides 9 are mounted on the rear portion of the bed 2. A cloth feeding mechanism (not shown) that drives a feed dog not shown in synchronization with the vertical movement of the needle bar 7, and a movable blade for cutting the end portion of the sewing cloth immediately before the sewing process are provided inside the bed 2.

Also, as shown in FIG. 3, a sewing machine motor 13 having a drive shaft with a drive gear 14 attached thereon is placed laterally on the rear portion inside the bed 2. A laterally extending main shaft 10 is rotatably supported by the sewing machine frame 20 in the front side of the sewing machine motor 13. A hand pulley 12 penetrating the side surface of the bed cover 2*b* (refer to FIG.1) is attached to the right end of the main shaft 10, allowing for a manual operation to be performed externally. Also, a follower gear 11 in mesh engagement with the drive gear 14 and located to the left side of the hand pulley 12 is attached to the right end of the main shaft 10. Thus, the rotation of the sewing machine motor 13 is conveyed to the follower gear 11 via the drive gear 14 and the main shaft 10 is rotated in a predetermined rotational direction (counterclockwise in right surface view).

Figure 4:
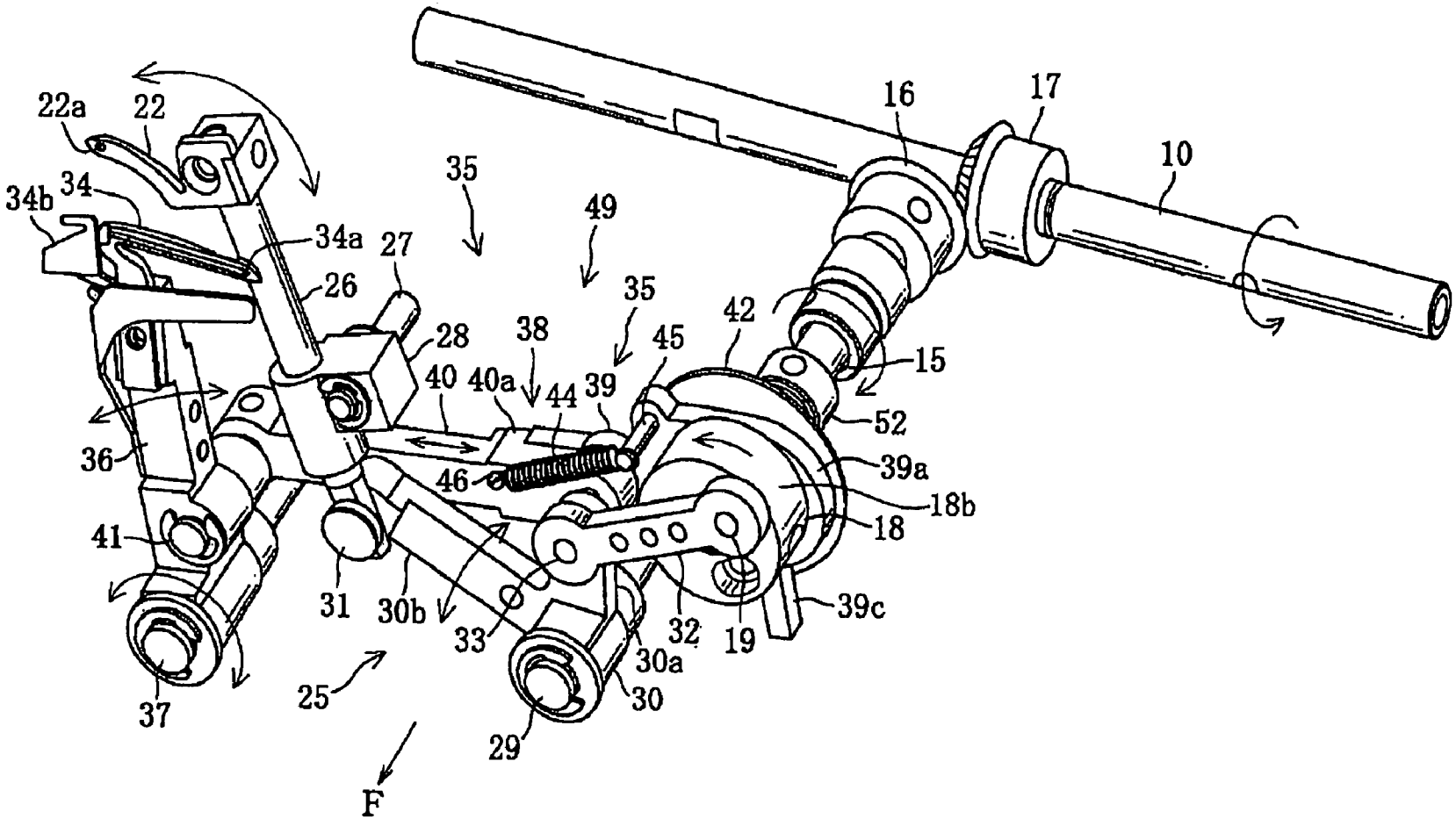
FIG. 4 is a front perspective view of a first and second swing link mechanism.
Figure 5:
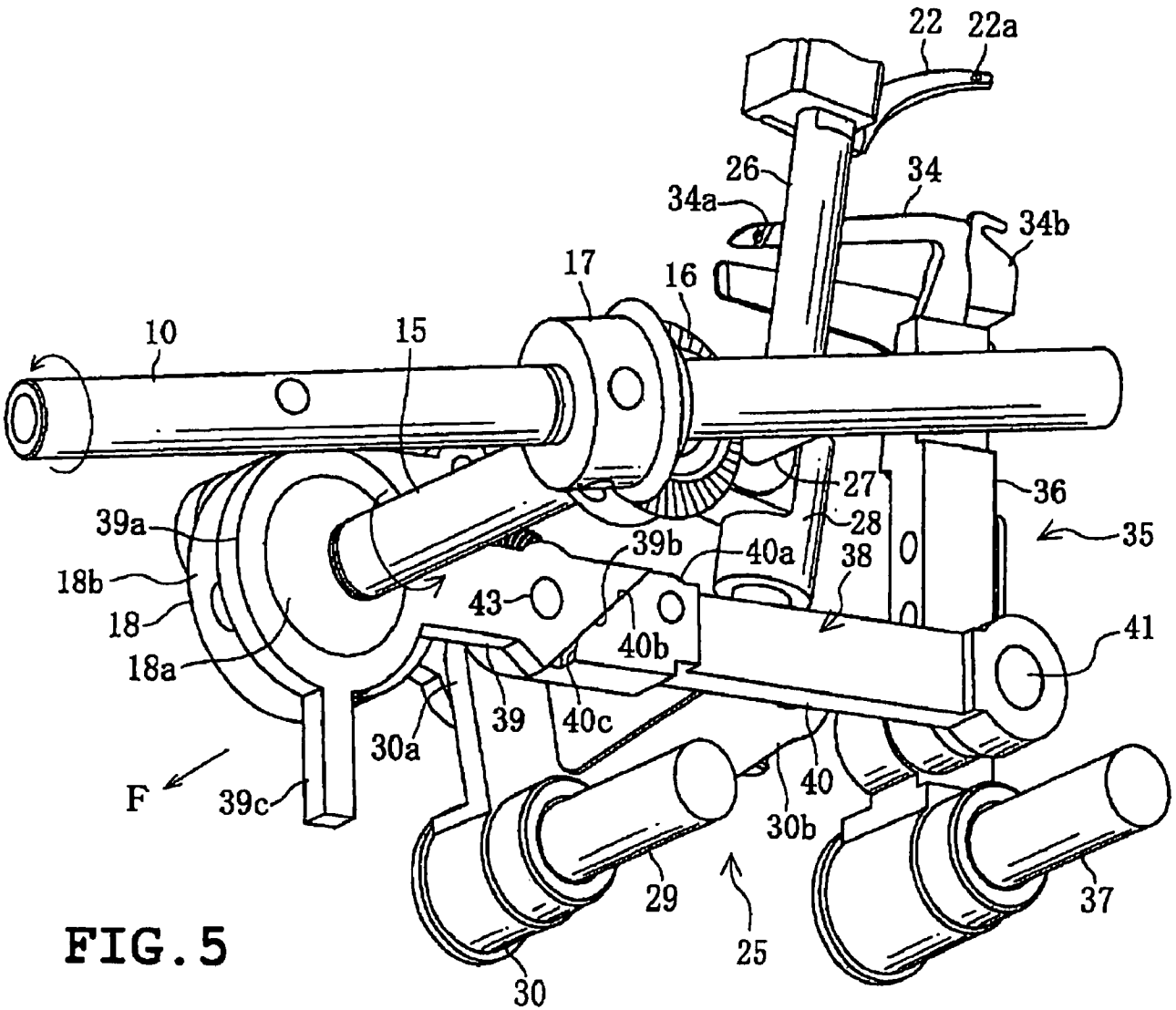
FIG. 5 is a rear perspective view of the first and second swing link mechanism.

Also, as shown in FIGS. 4 and 5, a bevel gear 17 is attached to the substantial middle of the main shaft 10. A bevel gear 16 fixed to a later described single looper drive shaft 15 is fitted perpendicularly with the front side of the bevel gear 17. At this point, the looper drive shaft 15 is arranged so as to extend in the forward direction perpendicular to the main shaft 10.

Then, the overlooper 22 and the underlooper 34 that execute overlock sewing in cooperation with the sewing needle 6 are provided in addition to a drive mechanism that swing the overlooper 22 and the underlooper 34 in synchronization with the vertical movement of the sewing needle 6 (needle bar 5). In the present embodiment, the overlooper 22, underlooper 34 and the corresponding drive mechanism are installed as a unitized looper unit 50.

The drive mechanism portion will be described in detail hereinafter with reference to FIGS. 4 to 12.

Figure 6:
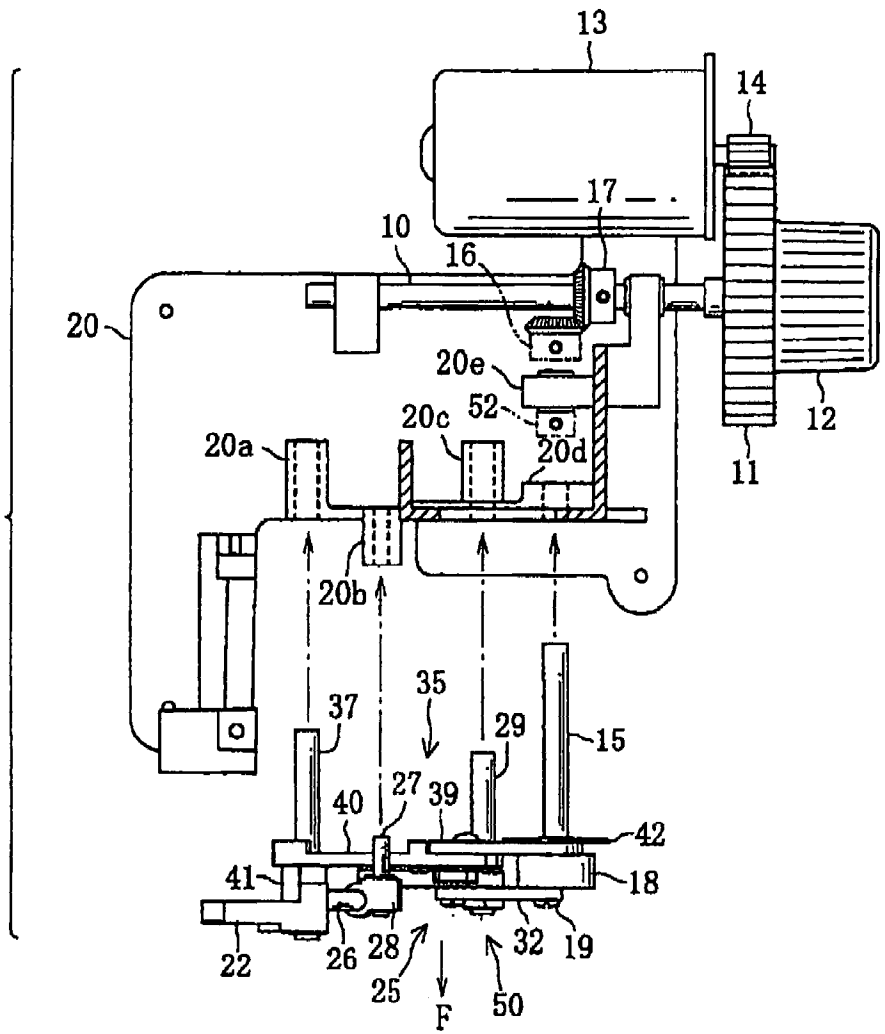
FIG. 6 is a plan view illustrating a sewing machine frame before attaching a looper unit.

The looper drive shaft 15 is rotatably supported by the sewing machine frame 20 (pivotal portions 20*d* and 20*e* shown in FIG. 6). A thick, disc-formed swing generating member 18 is fixed to the front end of the looper drive shaft 15.

As shown in FIGS. 4 and 5, the swing generating member 18 is integrally provided with a crank pin 19 (refer to FIG. 4) serving as a first swing generating portion in the front surface side of the disc member 18*b* arranged concentrically on the looper drive shaft 15 and an eccentric ring 18*a* (refer to FIG. 5) serving as a second swing generating portion in the rear surface side of the disc member 18*b*. The crank pin 19 and the eccentric ring 18*a* are respectively provided eccentrically with respect to the looper drive shaft 15 and are integrally rotated (circular movement) by conveying the rotation of the main shaft 10 to the swing generating member 18 via the bevel gear 16, 17 and the looper drive shaft 15.

At this point, the drive force generated by the crank pin 19 is conveyed to the overlooper 22 via a first swing link mechanism 25. Also, the drive force generated by the eccentric ring 18*a* is conveyed to the underlooper 34 via a second swing link mechanism 35. The first swing and second swing link mechanisms 25 and 35 are arranged so as to extend in the lateral direction perpendicular to the looper drive shaft 15. Among the above, first, the overlooper 22 and the first swing link mechanism 25 will be described hereinafter.

Figure 10:
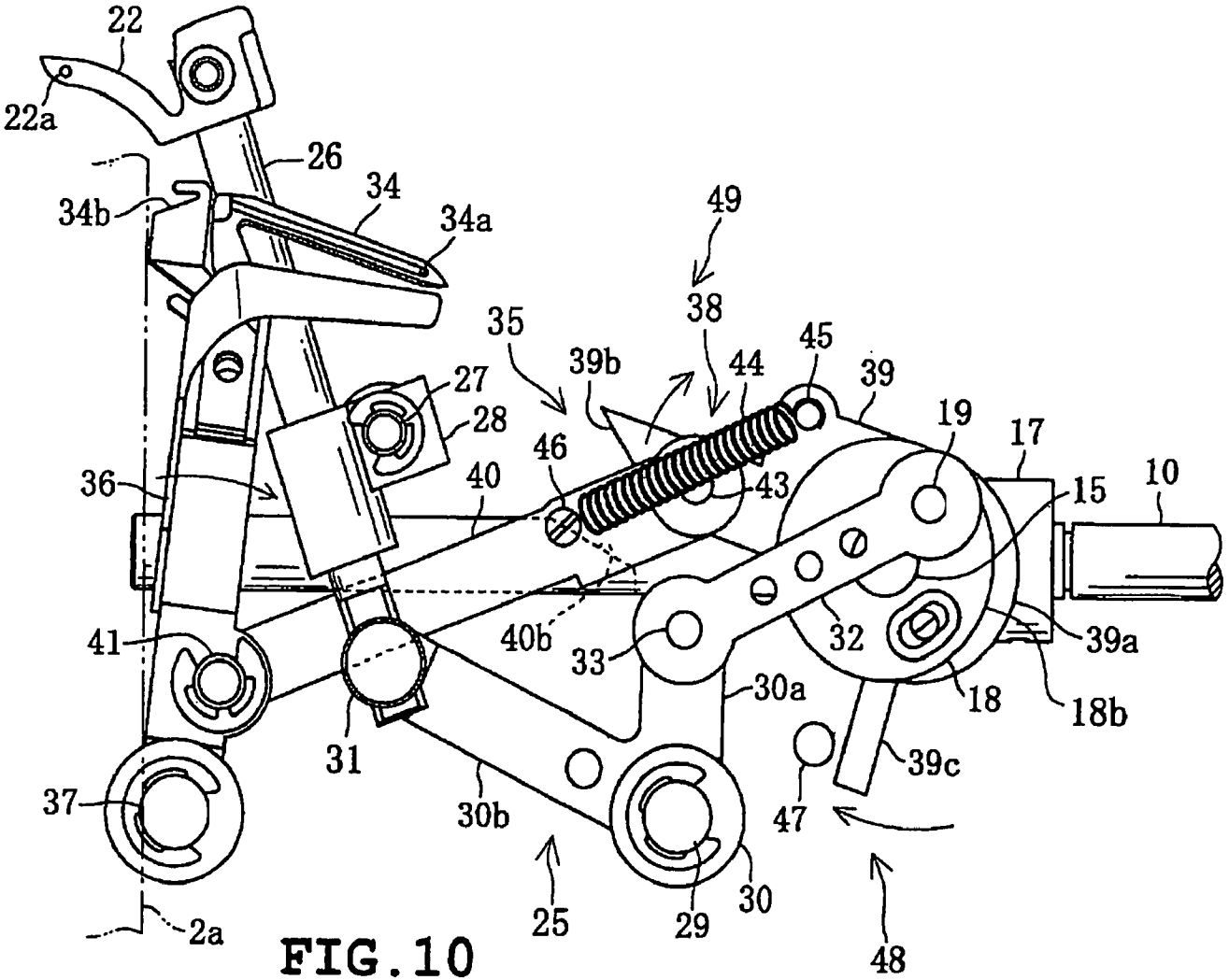
FIG. 10 is a front view of the first and the second link mechanism portion, wherein first and second split link members are in a bent disposition.

As shown in FIGS. 2, 4 and 10, the overlooper 22 having a threading eyelet 22*a* on the distal end thereof, is formed in an arch (hook) slightly curved to the left. The overlooper 22 is fixed on the upper end of a looper shaft 26 extending in a substantially vertical direction.

On the other hand, as shown in FIGS. 4 and 6, a forwardly extending pivot pin 27 is mounted on a portion slightly to the left of the sewing machine frame 20 (support portion 20*b* shown in FIG.6). A block-shaped pivot member 28 having a cylindrical aperture is rotatably supported on the front end portion of the pivot pin 27. The portion of the looper shaft 26 slightly below the middle thereof, is slidably supported by being inserted into the aperture of the pivot member 28. Thus, the looper shaft 26 and therefore the overlooper 22 are supported rotatably (swingably) in the lateral direction with the pivot pin 27 as the rotational center while being slidably arranged in the vertical direction with respect to the pivot member 28.

The first swing link mechanism 25 is provided with a connection link 32 and a swing link 30.

As shown in FIGS. 4 and 10, the swing link 30 is substantially v-shaped in front view, integrally having a first arm 30*a* and a second arm 30*b*. The swing link 30, as shown in FIGS. 5 and 6, is located slightly to the lower left of the looper drive shaft 15 with the substantial center thereof rotatably supported by a forwardly extending pivot shaft 29 fixed to the sewing machine frame 20 (support portion 20*c* shown in FIG. 6). The right end of the connection link 32 is rotatably connected to the crank pin 19. The first arm 30*a* of the swing link 30 is rotatably linked to the left end of the connection link 32 via a pivot pin 33. The end of the second arm 30*b* of the swing link 30 is rotatably connected to the lower end of the looper shaft 26 via a link pin 31.

Thus, the circular movement (drive force) of the crank pin 19 is conveyed to the overlooper 22 via the connection link 32, the swing link 30 and the looper shaft 26, consequently swinging the overlooper 22 in the lateral direction with a slight vertical movement. This swing movement is in synchronization with the vertical movement of the sewing needle 6 wherein the overlooper 22, when elevated, approaches the immediate rear side of the lowered sewing needle 6.

Figure 8:
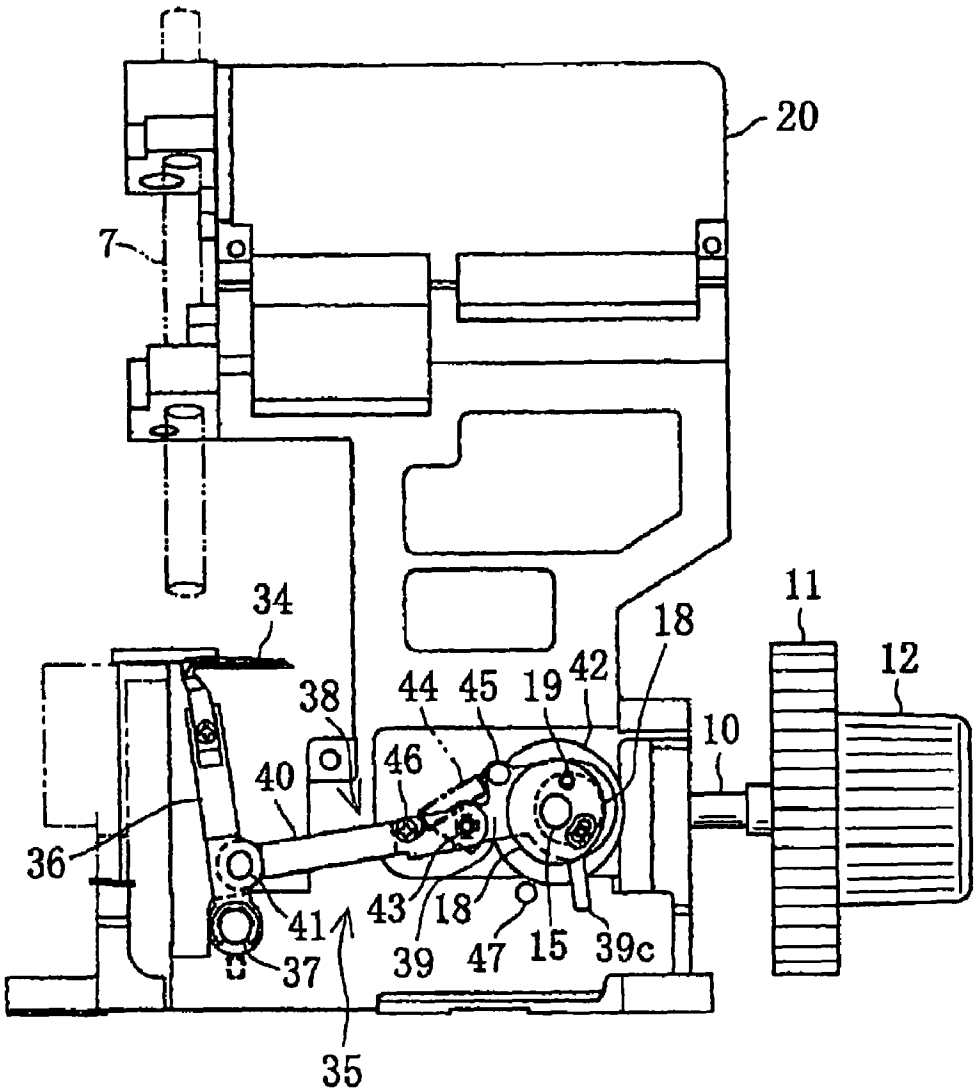
FIG. 8 is a front view after attachment of the looper unit, wherein the first swing link mechanism is omitted.
Figure 9:
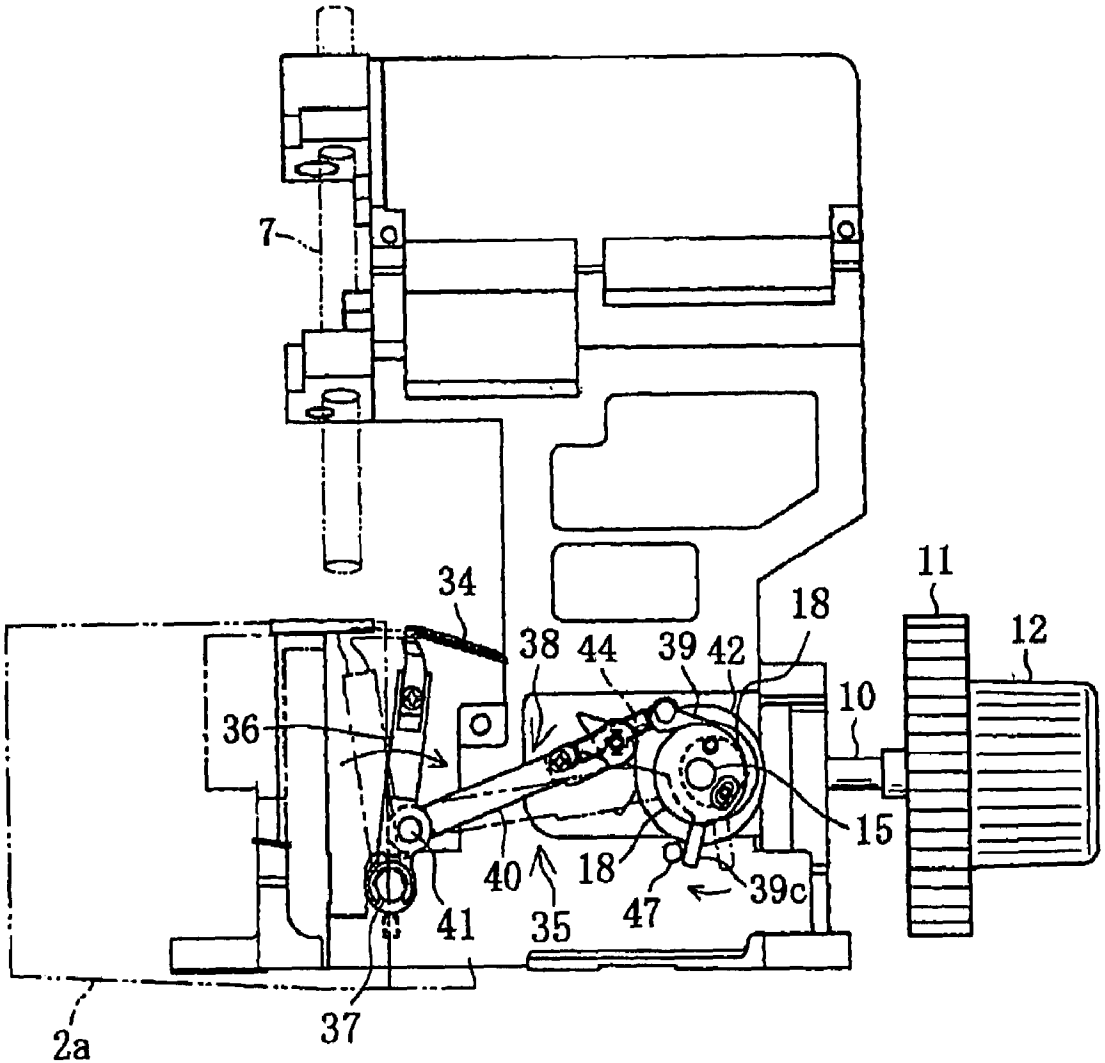
FIG. 9 corresponds to FIG. 8, wherein the underlooper is in a threading position.

Next, the underlooper 34 and the second swing link mechanism 35 will be described. As shown in FIGS. 2, 4, and 8, the underlooper 34, formed as a tip extending rightwardly and slightly downwardly, has a threading eyelet 34*a* on the distal end (right end) thereof and a thread engagement portion 34*b* on the upper portion of the base end (left end) thereof. The underlooper 34 is mounted on the upper end of the vertically extending operation lever 36. The lower end of operation lever 36 is rotatably supported by a pivot shaft 29 mounted on the sewing machine frame 20 (support portion 20*a* shown in FIG. 6) in a forwardly extending manner and is located to the left of the pivot shaft 37.

The operation lever 36 and a link member 38 constitute the second swing link mechanism 35. As will be described in detail hereinafter, the link member 38 is constructed by connecting a first split link member 39 situated in the right side and a second split link member 40 situated in the left side.

As shown in FIG. 5, the eccentric ring 18*a* is fitted to a ring 39*a* provided on the base end of the first split link member 39. The inner peripheral surface of the ring 39*a* slidably contacts the outer peripheral surface of the eccentric ring 18*a*. Also, because a circular protection plate 42 (refer to FIG. 4) is fixed on the rear surface of the eccentric ring 18*a*, the ring 39*a* does not come off from the eccentric ring 18*a* even when the eccentric ring 18*a* is rotated. An operation piece 39*c* downwardly extending from the lower end of the ring 39*a* is integrally provided on the first split link member 39. The distal end of the second split link member 40 is rotatably connected to the lower portion of the operation lever 36 via a connection pin 41.

Thus, the circular movement (drive force) of the eccentric ring 18*a* is conveyed to the underlooper 34 via the link member 38 and the operation lever 36, generating a swinging movement of the underlooper 34. During a normal sewing process, the underlooper 34 performs the swinging movement within a predetermined range (sewing position); however, a switch mechanism 49 which will be described hereinafter enables the underlooper 34 to swing further rightward beyond the aforementioned range so as to be moved to a threading position (refer to FIG. 9). When the underlooper 34 is in the threading position, the bed 2 becomes exposed to the exterior, and threading of the threading eyelet 34*a* and the thread engagement of the thread engagement portion 34*b* can be carried out externally.

The structure of the link member 38 and the switch mechanism 49 will be described hereinafter.

As shown in the drawings such as FIG. 5, the distal end (left end) of the first split link member 39 and the base end (right end) of the second split link member 40 are mutually linked in a rotatable manner by a link pin 43 such that the second split link member 40 is placed on top of the first split link member 39 in front view, thus forming the link member 38.

Figure 11:
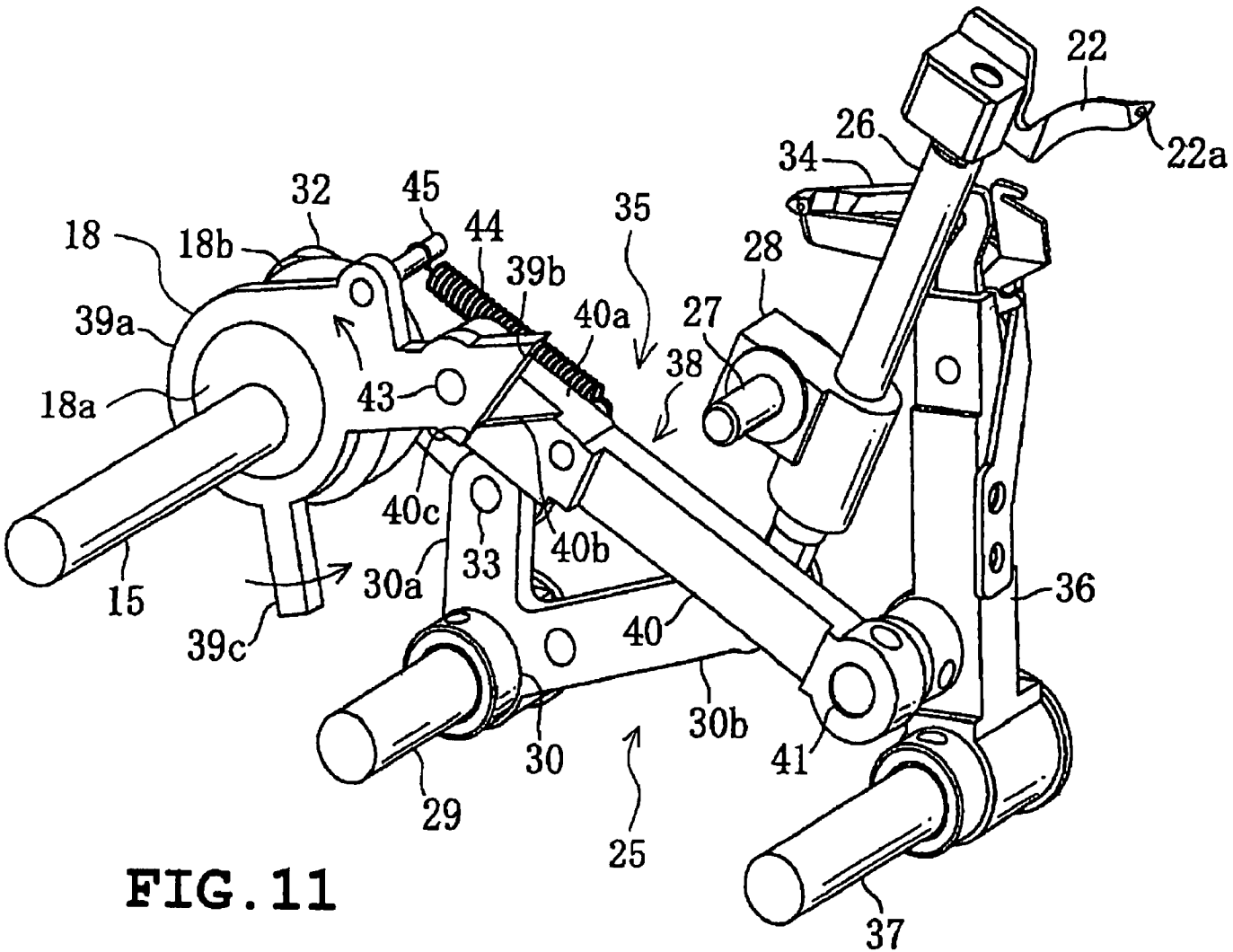
FIG. 11 is a perspective view taken from a rear surface of a drive mechanism portion, wherein the first and second split link members are in the bent disposition.

As shown in FIGS. 5 and 11, the distal end surface of the first split link member 39 defines an inclined first abutment regulating surface 39*b*. As opposed to this, a thickened portion 40*a* thickened towards the rear surface side is formed on the end of the second split linkmember 40 on the linkpin 43 side thereof. An inclined second abutment regulating surface 40*b* corresponding to the first abutment regulating surface 39*b* is formed on the right end surface of the thickened portion 40*a*. An engagement surface 40*c* is vertically formed in continuation below the second abutment regulating surface 40*b*.

When the first abutment regulating surface 39*b* and the second abutment regulating surface 40*b* are in abutment, the first and the second split link members 39 and 40 taken together assume a linear disposition forming a substantially straight line (refer to FIG. 5). The drive force generated by the eccentric ring 18*a* is conveyed to the underlooper 34 in such linear disposition.

On the other hand, when the first and the second split link members 39 and 40 rotate about the link pin 43 portion, as shown in FIGS.10 and 11, the engagement surface 40*c* and the first abutment regulating surface 39*b* abut each other so that the first and the second split link members 39 and 40 taken together form a bend so as to reveal an angular shape. The first and the second split link members 39 and 40 in such state are referred to be in a bent disposition. When the first and the second split link members 39 and 40 are in the bent disposition, the operation lever 36 connected to the second split link member 40 is further swung rightward so as to displace the underlooper 34 to the threading position.

Figure 12A:
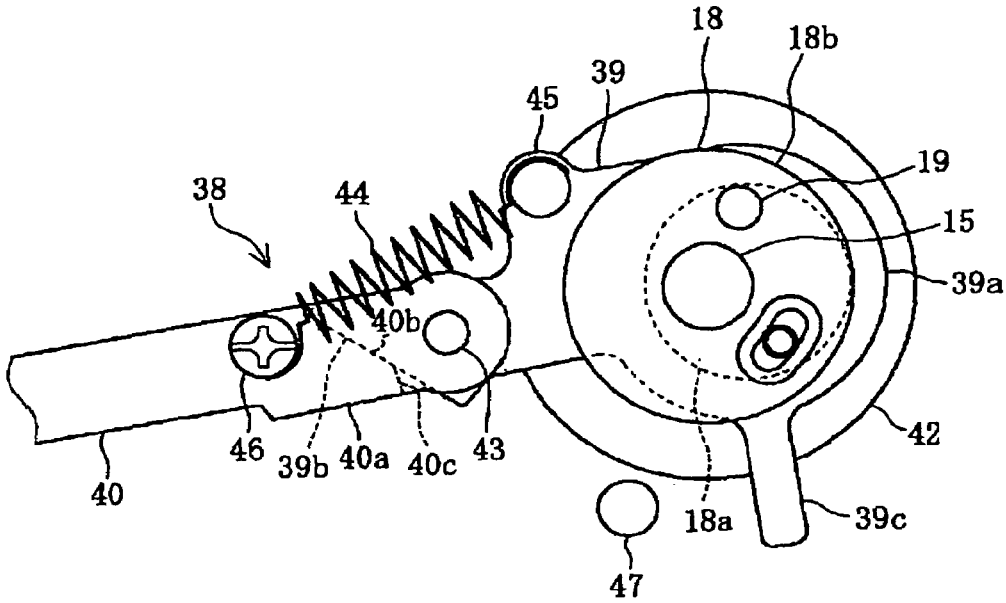
FIG. 12A is an exploded view taken near a helical extension spring, wherein the first and second split link members are in a linear disposition.
Figure 12B:
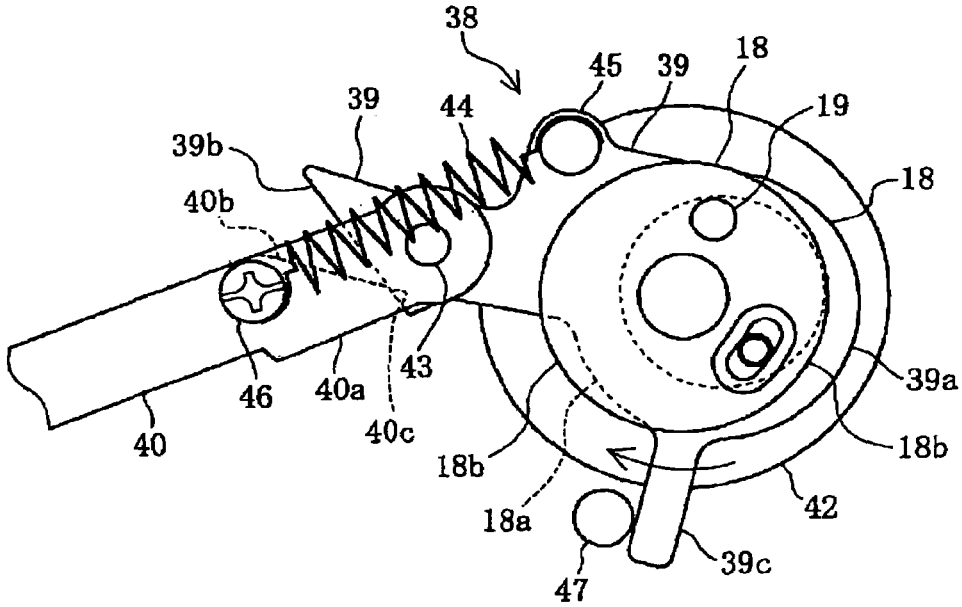
FIG. 12B corresponds to FIG. 12A, wherein the first and second split link members are in the linear disposition.

Also, as shown in the expanded views in FIGS. 12A and 12*b*, a helical extension spring 44 serving as a spring member is hooked between the first and the second split link members 39 and 40. One end of the helical extension spring 44 is engaged to the engagement pin 45 fixed to the upper portion of the ring 39*a* and the other end is fastened by the fixing screw 46.

In this case, the helical extension spring 44 is compressed when the first and the second split link members 39 and 40 are in the linear and bent dispositions, whereas when in an intermediate position between the linear and the bent dispositions, the helical extension spring 44 is stretched. Because of the pulling force operated by the helical extension spring 44, the first and the second abutment regulating surfaces 39*b* and 40*b* are placed in abutment by mutually pressing the other, thus retaining the linear disposition of the first and the second split link members 39 and 40. On the other hand, the engagement surface 40*c* and the first abutment regulating surface 39*b* are placed in abutment in a mutually pressed state, thus retaining the bent disposition of the first and the second split link members 39 and 40.

The linear and the bent dispositions of the first and the second split link members 39 and 40 are thus retained by a single helical extension spring 44. The switch between the first and the second split link members 39 and 40 can be carried out by forcibly rotating the first split link member 39 by a manual rotation of the operation piece 39*c* formed on the ring 39*a*.

Furthermore, in the present embodiment, a returning mechanism 48 is provided that automatically returns the first and the second split link members 39 and 40 to the linear disposition from the bent disposition upon sewing start. That is, in the sewing machine frame 20, as shown in FIGS. 8, 9, 10, 12A, and 12B, an abutment pin 47 serving as an abutting portion is provided near the operation piece 39*c*. The abutting pin 47 and the operation piece 39*c* constitute the returning mechanism 48.

As shown in FIG. 12A, when the first and the second split link members 39 and 40 are in the linear disposition, the abutment pin 47 located to the left of the operation piece 39*c* is distant from the operation piece 39*c*. In the linear disposition at the time of the sewing process, the operation piece 39*c* does not abut the abutting pin 47 even if the eccentric ring 18*a* is rotated. From this state, when a clockwise rotary operation of the operation piece 39*c* is carried out, as shown in FIG. 12B, the operation piece 39*c* is moved so as to approach the abutting pin 47.

In case sewing is started in this state, the operation piece 39*c* is moved leftward by the circular movement of the ring 39*a* accompanying the rotation of the eccentric ring 18*a*. Then, the operation piece 39*c* abuts the abutting pin 47 and is pressed and moved relatively rightward. Hence, the entire first split link member 39 is rotated in the counterclockwise direction. Thus, the first and the second split link members 39 and 40 are automatically switched from the bent disposition to the linear disposition in the sewing process.

As shown in FIGS. 6 and 11, the aforementioned looper drive shaft 15, the swing generating member 18, the first and the second swing link mechanisms 25 and 35, the overlooper 22 and the underlooper 34 are unitized so as to be assembled in advance as a looper unit 50. As shown in FIG. 6, pivotal portions 20*d* and 20*e* that support the looper drive shaft 15, and support portions 20*c*, 20*a* and 20*b* supporting the pivot shafts 29 and 37 and pivot pin 27 respectively are provided in the sewing machine frame 20. The front portion of the foregoing pivotal portions 20*d* and 20*e*, and the support portions 20*c*, 20*a* and 20*b* are opened.

Figure 7:
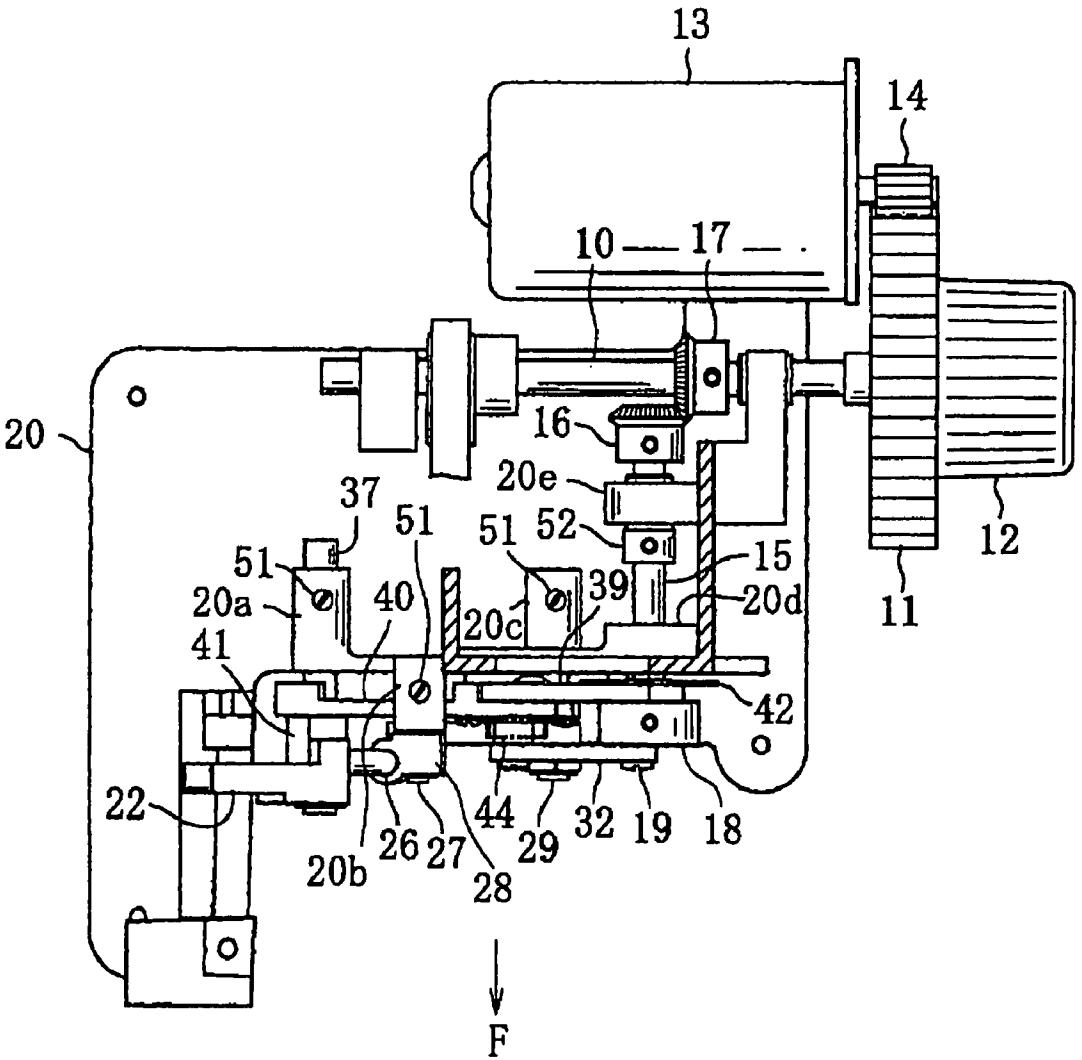
FIG. 7 is a plan view after attachment of the looper unit.

Therefore, as shown in FIG. 6, the looper unit 50 can be installed to the sewing machine frame 20 from the front side. More specifically, as shown in FIG. 7, the looper drive shaft 15 is inserted into the pivotal portions 20*d* and 20*e*. Then a setting collar 52 and the bevel gear 16 are attached so as to be connected to the main shaft 10. Timing adjustment is carried out by the bevel gears 16 and 17. Also, as shown in FIG. 7, the pivot shafts 29 and 37 and the pivot pin 27 are inserted into the support portions 20*c*, 20*a* and 20*b* respectively and are respectively fixed by fixing screws 51.

Next, the operation of the overlock sewing machine 1 according to the above described configuration will be described hereunder.

When the sewing process is started in the overlock sewing machine 1, the main shaft 10 is rotated by the sewing machine motor 13, and the needle bar 7 and the sewing needle 6 are vertically moved. The rotation of the main shaft 10 is also conveyed to the looper drive shaft 15 and rotates the swing generating member 18. Then, the drive force of the crank pin 19 is conveyed to the overlooper 22 via the first swing link mechanism 25 and swings the overlooper 22. Similarly, the drive force of the eccentric ring 18*a* is conveyed to the underlooper 34 via the second swing link mechanism 35 and swings the underlooper 34. The overlooper 22 and the underloopers 34 are driven in synchronization with the sewing needle 6, and the cooperation of the foregoing forms overlock stitches on the cloth placed on the bed 2. The first and the second split link members 39 and 40 are in the linear disposition in the above described sewing state.

When carrying out the sewing process the looper thread (not shown) needs to be set to the underlooper 34. First the user must pull open the bed cover 2*c* located in the right side of the free bed 2*a*. Then the main shaft 10 is rotated by manually operating the hand pulley 12 and the underlooper 34 is moved to the right end of the swing range indicated in FIG. 8.

In this state, the user subsequently moves the operation piece 39*c* visible in front view to the left (refer to FIG. 9) with the user's fingers. As a result, the first and the second split link members 39 and 40 are switched to the bent disposition and the underlooper 34 makes a large rotation to the right side (refer to FIG. 10) of the free bed 2*a* and is moved to the threading position in which the entire underlooper 34 is exposed to the exterior. Thus, the user is able to easily perform the threading operation to the threading eyelet 34*a* of the underlooper 34 and the thread engagement work of the thread engagement portion 34*b*.

After completing the looper thread setting, by the user's operation of moving the operation piece 39*c* to the original position, the sewing process can be started with the first and the second split link members 39 and 40 in the linear disposition. The user may occasionally forget to move the operation piece 39*c* to the original position; however, when a sewing start switch (not shown) is operated and sewing is started, as described earlier, the operation piece 39*c* abuts the abutting pin 47 and the bent disposition is automatically moved back to the linear disposition. Therefore, when sewing is carried out with the overlock sewing machine 1, the overlock stitches are formed in a state in which the linear disposition is retained by the helical extension spring 44, that is, in the state where the underlooper 34 is constantly retained in the position within the aforementioned swing range.

As described above, the overlock sewing machine 1 according to the present embodiment has the following effects. Since the swing generating member 18 integrally provided with the crank pin 19 for swinging the overlooper 22 and the eccentric ring 18*a* for swinging the underlooper 34 is fixed to a single looper drive shaft 15, the number of parts can be reduced as compared to the conventional double looper drive shafts. Thus, the construction is simplified.

Also, since the crank pin 19 and the eccentric ring 18*a* are integrally constructed, timing adjustment is required only once; which, taken together with the simplification of the drive mechanism, reduces the efforts required for the assembly work and cuts down on manufacturing cost. Also, Enlargement of the drive mechanism can be restrained.

Furthermore, the overlooper 22 and underlooper 34 and the associated drive mechanism taken together are unitized as the looper unit 50. Thus, the installation to the sewing machine frame 20 becomes easier; thereby further improving the ease of installation.

Also, in the present embodiment, by providing the switch mechanism that switches the underlooper 34 from the sewing position to the threading position, the entire underlooper 34 can be exposed to the exterior. Thus, the looper thread can be passed through the threading eyelet 34*a* and engaged to the thread engagement portion 34*b* directly from the exterior. Therefore, a mechanism for engaging the thread to the base end of the underlooper 34 placed inside the bed can be eliminated, thereby simplifying the thread engagement work.

Moreover, at the time of sewing start, since the switch mechanism 49, automatically returns the underlooper 34 from the threading position to the sewing position by the returning mechanism 48, even if the user forgets to perform the returning operation of the underlooper 34, sewing can be started without interruption.

By constructing the link member 38 from the first and the second split link members 39 and 40 and switching the foregoing between the linear and the bent disposition, the underlooper 34 is switched from the sewing position to the threading position. Thus, the construction of the switch mechanism 49 can be simplified. Also, since the linear and the bent dispositions of the first and the second split link members 39 and 40 can be respectively retained by a single helical extension spring 44, the construction to retain the dispositions can be simplified.

Next, modification of the above described embodiment will be explained.

In alternative to retaining the linear and bent dispositions of the first and the second split link members 39 and 40 by a helical extension spring 44, one protrusion can be formed on the distal end of the first split link member 39 and 2 recesses (recesses for the linear and bent dispositions) spaced apart at predetermined distance can be formed on the thickened portion 40*a* of the second split link member 40. When in the linear disposition, the protrusion is fitted to the recess for the linear disposition and when in bent disposition, the protrusion is fitted to the recess for the bent disposition so as to retain each disposition.

The first and the second split link members 39 and 40 are bent in the upward direction in the bent disposition. However the first and the second split link members 39 and 40 may alternatively be bent downward.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

What is claimed is:

1. An overlock sewing machine forming overlock stitches by swinging an overlooper and an underlooper in synchronization with a vertical movement of a sewing needle, the overlock sewing machine comprising:

a main shaft rotated by a sewing machine motor and vertically driving the sewing needle;

a looper drive shaft having a shaft line perpendicular to the main shaft and rotated by the rotation of the main shaft;

a swing generating member fixed to the looper drive shaft and having a first swing generating portion for swinging the overlooper and a second swing generating portion for swinging the underlooper;

a first swing link mechanism arranged in a direction perpendicular to the looper drive shaft and swinging the overlooper by conveying thereto a drive force generated by the first swing generating portion; and a second swing link mechanism arranged in a direction perpendicular to the looper drive shaft and swinging the underlooper by conveying thereto a drive force generated by the second swing generating portion, wherein the first swing generating portion comprises a crank pin eccentric with respect to the looper drive shaft, and the second swing generating portion comprises an eccentric ring eccentric with respect to the looper drive shaft; the swing generating member being integrally provided with the crank pin and the eccentric ring.

2. The overlock sewing machine according to claim 1, wherein the second swing link mechanism comprises an operation lever supporting and swinging the underlooper, a link member linking the operation lever and the eccentric ring, and a switch mechanism switching the underlooper from the sewing position to the threading position which is outside a swing range at the time of sewing, wherein when the underlooper is in the threading position, threading of a threading eyelet in a distal end of the underlooper and thread engagement to a thread engagement portion in a base end of the underlooper can be performed externally.

3. The overlock sewing machine according to claim 2, wherein the looper drive shaft, the swing generating member, the first and the second swing link mechanisms, the overlooper and the underlooper constitute a looper unit, the looper unit being installable to the sewing machine frame.

4. The overlock sewing machine according to claim 2, wherein a first split link member having a base end thereof linked to the eccentric ring and a second split link member having a distal end thereof linked to the operation lever are connected mutually rotatably by a connection pin, and wherein the switch mechanism switches the first and the second split link members between the linear disposition in which the first and the second split link members are in a substantially linear state conveying the drive force generated by the eccentric ring to the underlooper and the bent disposition in which the first and the second split link members are in a substantially bent state displacing the underlooper to the threading position.

5. The overlock sewing machine according to claim 4, wherein the looper drive shaft, the swing generating member, the first and the second swing link mechanisms, the overlooper and the underlooper constitute a looper unit, the looper unit being installable to the sewing machine frame.

6. The overlock sewing machine according to claim 4, further comprising a spring member for retaining the linear and the bent dispositions of the first and the second split link members, the spring member being hooked between the first and the second split link members.

7. The overlock sewing machine according to claim 6, wherein the looper drive shaft, the swing generating member, the first and the second swing link mechanisms, the overlooper and the underlooper constitute a looper unit, the looper unit being installable to the sewing machine frame.

8. The overlock sewing machine according to claim 4, wherein the switch mechanism has a returning mechanism in which upon sewing start, the first and the second split link members are automatically returned to the liner disposition from the bent disposition.

9. The overlock sewing machine according to claim 8, wherein the looper drive shaft, the swing generating member, the first and the second swing link mechanisms, the overlooper and the underlooper constitute a looper unit, the looper unit being installable to the sewing machine frame.

10. The overlock sewing machine according to claim 8, wherein the returning mechanism comprises an operation piece provided on the first split link member and an abutting portion provided on a sewing machine frame, such that the eccentric ring is rotated when the first and the second split link members are in the bent disposition, the operation piece abuts the abutting portion so that the first and the second split link members are returned to the linear disposition in which the operation piece does not abut the abutting portion despite the rotation of the eccentric ring.

11. The overlock sewing machine according to claim 10, wherein the looper drive shaft, the swing generating member, the first and the second swing link mechanisms, the overlooper and the underlooper constitute a looper unit, the looper unit being installable to the sewing machine frame.

12. The overlock sewing machine according to claim 1, wherein the looper drive shaft, the swing generating member, the first and the second swing link mechanisms, the overlooper and the underlooper constitute a looper unit, the looper unit being installable to the sewing machine frame.

13. The overlock sewing machine according to claim 1, wherein the looper drive shaft, the swing generating member, the first and the second swing link mechanisms, the overlooper and the underlooper constitute a looper unit, the looper unit being installable to the sewing machine frame.

14. An overlock sewing machine forming overlock stitches by a swinging movement of an overlooper and an underlooper in synchronization with a vertical movement of a sewing needle, the overlock sewing machine comprising:

a main shaft rotated by a sewing machine motor and vertically driving the sewing needle;

a looper drive shaft having a shaft line perpendicular to the main shaft and rotated by the rotation of the main shaft;

a swing generating member fixed to the looper drive shaft and having a first swing generating portion for swinging the overlooper and a second swing generating portion for swinging the underlooper;

a first swing link mechanism arranged in a direction perpendicular to the looper drive shaft and swinging the overlooper by conveying thereto a drive force generated by the first swing generating portion;

a second swing link mechanism arranged in a direction perpendicular to the looper drive shaft and swinging the underlooper by conveying thereto a drive force generated by the second swing generating portion;

a switch mechanism switching the underlooper from a sewing position to a threading position which is outside a swing range at the time of sewing and in which threading of a threading eyelet in a distal end of the underlooper and a thread engagement to the thread engagement portion in a base end of the underlooper can be performed externally; and a returning mechanism automatically returning the underlooper from the threading position to the sewing position upon sewing start.

15. The overlock sewing machine according to claim 14, wherein the returning mechanism comprises an operation piece provided on the second swing generating portion or the second swing link mechanism and an abutting portion provided on a sewing machine frame, such that the looper drive shaft is rotated when the underlooper is in the threading position, the operation piece abuts the abutting so that the first and the second split link members are returned to the sewing position, whereas when the underlooper is in the sewing position, the operation piece does not abut the abutting portion despite the rotation of the looper drive shaft.

* * * * *